US005358686A

United States Patent [19]

Parris et al.

[11] Patent Number: 5,358,686

[45] Date of Patent: Oct. 25, 1994

[54] TITANIUM ALLOY CONTAINING AL, V, MO, FE, AND OXYGEN FOR PLATE APPLICATIONS

[76] Inventors: Warren M. Parris, 1804 Loch Lomond Way, Las Vegas, Nev. 89102; James A. Hall, 2454 S. Paseo Loma Cir., Mesa, Ariz. 85202; Paul J. Bania, 1533 Kay Ct., Boulder City, Nev. 89055; Ivan L. Caplan, 142 Tall Tree Trail, Arnold, Md. 21012

[21] Appl. No.: 18,394

[22] Filed: Feb. 17, 1993

[51] Int. Cl.[5] ..... C22C 14/00

[52] U.S. Cl. ..... 420/419; 148/421; 148/669; 420/418

[58] Field of Search ..... 420/419, 418; 148/421, 148/669

[56] References Cited

U.S. PATENT DOCUMENTS 3,619,184 11/1971 Bomberger, Jr. et al. ..... 75/175.5
5,124,121 6/1992 Ogawa et al. ..... 148/669

FOREIGN PATENT DOCUMENTS 0436717 12/1974 U.S.S.R. ..... 420/419
436717 12/1974 U.S.S.R. .
0440226 2/1975 U.S.S.R. ..... 420/419
447450 3/1975 U.S.S.R. .

OTHER PUBLICATIONS

Chemical Abstracts, vol. 96, No. 6, Feb. 8, 1982.
Chemical Abstracts, vol. 97, No. 14, Oct. 4, 1982.

*Primary Examiner*—Upendra Roy
*Attorney, Agent, or Firm*—Finnegan, Henderson, Farabow, Garrett & Dunner

[57] ABSTRACT

A titanium-base alloy, and weldment made therefrom, consisting essentially of, in weight percent, aluminum 4 to 5.5, preferably 5.0, tin up to 2.5, preferably 0.5 to 1.5 or 1; zirconium up to 2.5, preferably 0.5 to 1.5 or about 1; vanadium 0.5 to 2.5, preferably 0.5 to 1.5 or about 1; molybdenum 0.3 to 1, preferably, 0.66 to 1 or about 0.8; silicon up to 0.15, preferably 0.07 to 0.13 or about 0.1; oxygen 0.04 to 0.12, preferably 0.07 to 0.11 or about 0.09; iron 0.01 to 0.12, preferably 0.01 to 0.09 or about 0.07 and balance titanium and incidental impurities.

4 Claims, 3 Drawing Sheets

TITANIUM ALLOY CONTAINING AL, V, MO, FE, AND OXYGEN FOR PLATE APPLICATIONS

BACKGROUND OF THE INVENTION

1. Field of the Invention

This invention relates to a titanium-base alloy having a combination of high strength and toughness.

2. Description of the Prior Art

Titanium base alloys are known for use in various structural applications where the strength-to-weight ratio of titanium is required. Specifically, there are applications for titanium base alloys wherein the alloy in plate form is fabricated to produce structures, including marine structures, that are subjected to cyclical high-pressure application, such as in the construction of pressure vessels and submarine hulls. In these applications, it is important that the alloy have a combination of high strength and toughness, particularly fracture toughness. Specifically, in this regard, it is important that the alloy exhibit a resistance to failure by crack initiation and propagation in the presence of a defect when the structure embodying the alloy is subjected to high-pressure application. Moreover, it is important that the alloy exhibit high strength and toughness in both the welded and unwelded condition, because structures of this type are fabricated by welding. In marine applications it is also necessary that the alloy exhibit a high degree of resistance to stress corrosion cracking (SCC) in an aqueous 3.5% NaCl solution.

Titanium base alloys having this combination of properties are known in the art. These conventional alloys, however, to achieve the desired combination of high strength and toughness require relatively high contents of niobium and/or tantalum. These are expensive alloying additions and add considerably to the cost of the alloy.

SUMMARY OF THE INVENTION

Figure 1:
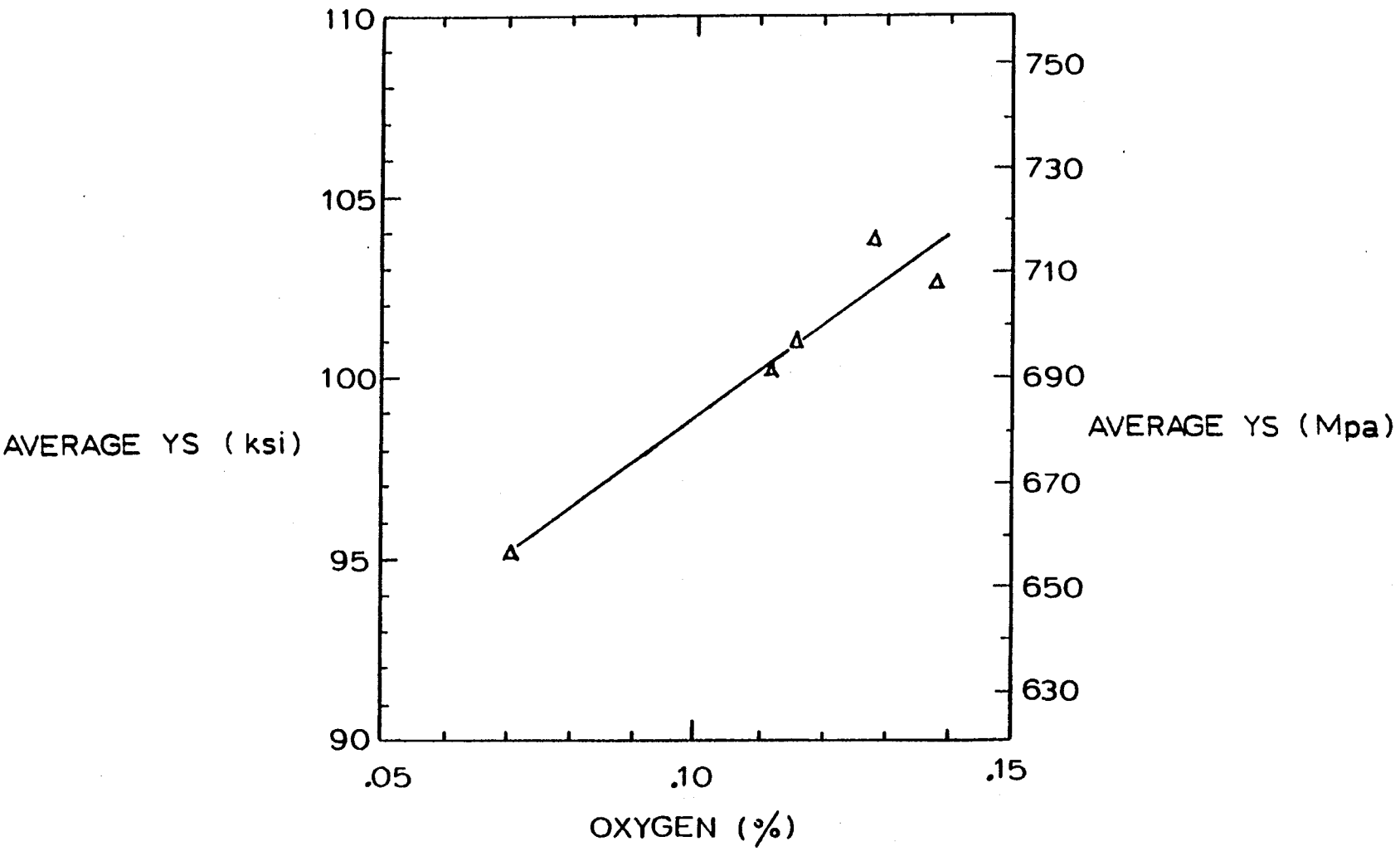
FIG. 1 is a graph showing the effect of oxygen content on yield strength (YS) for the alloy Ti-5Al-2Zr-2V-0.5Mo.

It is accordingly a primary object of the present invention to provide a titanium base alloy adapted for the production of plates that may be used in the manufacture of a welded structure, which alloy exhibits high strength and toughness, particularly fracture toughness, in both the welded and unwelded condition, and which also exhibits a high degree of resistance to stress corrosion cracking (SCC) in an aqueous 3.5% NaCl solution.

An additional object of the invention is to provide an alloy having the aforementioned properties that is of a relatively economical composition not requiring significant additions of expensive alloying elements.

Broadly, in accordance with the invention, there is provided a titanium base alloy consisting essentially of, in weight %, aluminum 4 to 5.5, preferably 4.5 to 5.5 or about 5; tin up to 2.5, preferably 0.5 to 1.5 or 1; zirconium up to 2.5, preferably 0.5 to 1.5 or about 1; vanadium 0.5 to 2.5, preferably 0.5 to 1.5 or about 1; molybdenum 0.3 to 1, preferably 0.6 to 1 or about 0.8; silicon up to 0.15, preferably 0.07 to 0.13 or about 0.1; oxygen 0.04 to 0.12, preferably 0.07 to 0.11 or about 0.09; iron 0.01 to 0.12, preferably 0.01 to 0.09 or about 0.07 and balance titanium and incidental impurities.

The alloy is particularly adapted for the production of welded structures. For this purpose, typically the alloy would be vacuum arc melted, forged and then rolled to produce plates, which plates would be welded to form the desired fabricated structures.

As will be demonstrated hereinafter, with respect to the alloy of the invention, aluminum is a necessary alloying addition for purposes of providing yield strength but if aluminum is above the limits of the invention, it will adversely affect weld toughness. High aluminum is also generally known to adversely affect SCC resistance.

Tin serves the same function as aluminum from the standpoint of improving the yield strength but its effect in this regard is not as great as with aluminum.

Zirconium provides a mild strengthening effect with a small adverse effect on toughness and particularly weld toughness. Consequently, zirconium is advantageous for achieving the desired combination of high strength and toughness.

Silicon is present as a solid solution strengthening element. If, however, the silicon limit in accordance with the invention is exceeded this will result in the silicon content exceeding the solubility limit and thus significant silicide formation can result, which will degrade the desired toughness of the alloy. In this regard, zirconium serves to beneficially affect any silicide dispersion from the standpoint of rendering the silicides present smaller and uniformly dispersed. By having a fine uniform dispersion of any silicides present, such decreases the adverse affect of the silicides with respect to toughness.

Vanadium is present as a beta stabilizer. In the amounts present it has no significant effect on strength or toughness but is known to improve forging and rolling characteristics.

Molybdenum in the amounts present in the alloy has little or no effect on strength but significantly improves unwelded toughness and is an essential alloying addition in this regard. If, however, the upper limit for molybdenum in accordance with the invention is exceeded the toughness of the alloy weldments will be significantly adversely affected. Specifically, in this regard if the upper limit for molybdenum is exceeded hardening will result in the weld heat-affected zone with an attendant loss of toughness within this area.

The presence of oxygen within the limits of the invention improves strength but if the upper limit is exceeded such will have an adverse effect on toughness. High oxygen is also generally known to reduce SCC resistance.

Likewise, iron provides a strengthening effect but will adversely affect weld toughness and thus must be controlled within the limits of the invention.

In the examples and throughout the specification and claims, all parts and percentages are by weight percent unless otherwise specified.

DETAILED DESCRIPTION OF THE PREFERRED EMBODIMENT

As discussed above, in design applications where a combination of high strength and toughness is required when a structure is subjected to cyclic pressure application, it is significant that the alloy from which the structure is made exhibit resistance to crack propagation under this cyclic pressure application. As will be demonstrated by the data presented herein, the alloy of the invention achieves an improvement with respect to energy toughness, which improvement is surprisingly unrelated to linear elastic fracture toughness.

For the past two decades, designers of fracture-critical alloys, such as for aerospace applications, have been using the linear-elastic fracture mechanics (LEFM) approach to design. Through this approach, a material property known as fracture toughness ($K_c$) has emerged as a common design parameter. In simplified terms, the material's ability to withstand an applied load in the presence of a crack (or flaw) without catastrophic failure is measured by the LEFM fracture toughness, as follows:

$$K_c = \sigma_c(\pi a_c)^{\frac{1}{2}}$$

where $K_c$=LEFM fracture toughness (ksi−in$^{\frac{1}{2}}$)

$\sigma_c$=critical stress (ksi)

$a_c$=critical crack size (in)

Since $K_c$ is a material constant, it is clear that as the crack size is increased, the critical stress is proportionally decreased. On the other hand, as the applied stress is increased, the tolerable crack size is decreased. Such principles are often used in designing structures which are fracture critical.

Many titanium alloys and processes have been developed in an attempt to maximize the material's LEFM fracture toughness characteristics. For example, it has been clearly shown that a beta processed microstructure of an alpha or alpha/beta alloy exhibits considerably higher LEFM fracture toughness than an alpha/-beta processed microstructure. Also, chemistry has been shown to affect LEFM fracture toughness. For example in the conventional Ti-6Al4V alloy, lowering oxygen from the (standard) 0.18 wt. pct level to the (extra low interstitial) 0.13 wt. pct level has been shown to significantly improve LEFM fracture toughness, although at a sacrifice in strength. Thus, both chemistry and microstructure are known to affect LEFM fracture toughness.

In recent years, a new design criterion has been emerging—that of an energy toughness. The primary difference between the LEFM approach and the energy approach is that the LEFM approach assumes that a crack will progress catastrophically once the material passes beyond elastic behavior—regardless of whether or not the crack has actually started to propagate. By the energy approach, the actual extension of the crack is measured and the energy required to physically start the crack extension process is determined. Energy related toughness is usually expressed in units such as in-lb/in$^2$ or KJ/m$^2$.

To determine this property the precracked Charpy slow-bend fracture test was chosen as a relatively rapid and inexpensive screening test for fracture toughness testing. This test does not meet the stringent requirements of ASTM E399-78 for linear-elastic fracture toughness ($K_{Ic}$) testing or ASTM E813-81 for ductile fracture toughness ($J_{Ic}$) testing, but it is useful for comparing alloys of a given class. The specimens used were similar in design to the standard Charpy V-notch impact specimen (ASTM E23-72), except for a larger width and a sharper notch root radius. The larger width improved control of crack growth during both fatigue precracking and fracture testing, and the sharper notch root radius facilitated initiation of the fatigue precrack.

The specimens were precracked by cyclic loading in three-point bending at a minimum/maximum load ratio of 0.1. The precracking conditions conformed to the requirements of ASTM D399-78. The maximum stress intensity of the fatigue cycle, $K_f$(max), at the end of precracking ranged from 23 to 37.7 MPa in$^{\frac{1}{2}}$ (21 to 34.3 ksi in$^{\frac{1}{2}}$). The precracks were grown to a length of 4.6-mm (0.18-in) (including the notch depth) on the sides of the specimen. Because of crack-front curvature, the cracks averaged about 4–8-mm (0.19-in) through the thickness. This resulted in a precrack length/width specimen ratio (a/W) of about 0.4. After precracking, the specimens were side-grooved to a total depth of 10% of the thickness in order to suppress shear lip formation. This also tended to minimize the crack curvature problems.

The specimens were tested on a three-point bend fixture which conformed to ASTM E399-78 and ASTM E813-81, using a span/width ratio (S/W) of 4. An extensometer mounted on the back of the bend fixture was used to measure the deflection of the specimen at mid-span. The tests were performed in deflection control from the extensometer at a constant deflection rate of 0.32-mm (0.0125-in)/minute. Load versus deflection was autographically recorded. The specimens were loaded through the maximum load ($P_{max}$) and unloaded at either 0.90 or 0.75 $P_{max}$.

Prior to testing, the specimens were heated for short terms at 482° C. (900° F.) to heat tint the precrack surfaces. After testing, they were heat tinted at 427° C. (800° F.) to mark the crack growth area. They were then broken in a pendulum-type impact testing machine. The precrack length and the total crack length corresponding to the unloading point were measured on the fracture surface at five equally spaced points across the net specimen thickness, using a micrometer-calibrated traveling microscope stage. The total area within the loading-unloading loop of the load-deflection record and the area up the maximum load were measured with a planimeter.

From each test, the following three fracture-toughness parameters were calculated:

$$K_Q = \frac{P_Q S}{(B \cdot B_N)^{\frac{1}{2}} W^{3/2}} f(a_{03}/W)$$

$$\overline{W}/A = \frac{A_L C_1 C_2}{B_N(a_{f5} - a_{05})}$$

$$Jm = \frac{2A_m C_1 C_2}{B_N(\overline{W} - a_{05})}$$

Where:

$K_Q$=Conditional linear-elastic fracture toughness parameter-MPa m$^{\frac{1}{2}}$ (ksi in$^{\frac{1}{2}}$)

W/A=Energy toughness constituting the average energy absorbed per unit of crack growth area-kJ/m$^2$ (in-lb/in$^2$)

$J_m$=Elastic-plastic fracture parameter (J-integral) at maximum load-kJ/m$^2$ (in-lb/in$^2$)

$P_Q$=Conditional load at intersection of 5% secant line with load-deflection record-kN(lb)

S=Specimen support span-cm(in)

B=Specimen thickness-cm(in) $B_N$=Net specimen thickness between side ggrooves-cm(in)

W=Specimen width-cm(in)

In Table I the metallurgical composition for heats produced in developing and demonstrating the invention are reported.

TABLE I

| Heat | Weight (Lbs) | Al | Sn | Zr | V | Mo | Fe | O2 | Other | Comments |
|---|---|---|---|---|---|---|---|---|---|---|
| | | Wt. % - Balance Titanium | | | | | | | | |
| V5954 | 30 | 6.4 | — | — | — | .71 | .15 | .095 | 2.0Cb, 1.1Ta | Baseline Alloy |
| V6026 | 100 | 6.2 | — | — | — | .83 | .11 | .12 | 2.1Cb, 1.0Ta | Baseline Alloy |
| V6055 | 350 | 6.1 | — | — | — | .77 | .06 | .07 | 2.1Cb, 1.1Ta | Baseline Alloy |
| V6027 | 100 | 6.1 | — | — | 4.0 | — | .15 | .12 | — | Conventional Alloys |
| V6065 | 50 | 6.2 | — | — | 4.1 | — | .07 | .10 | — | Conventional Alloys |
| V6049 | | 6.0 | — | — | 3.1 | — | .14 | .10 | — | Invention Alloys |
| V6050 | | 6.0 | — | — | 2.6 | — | .56 | .10 | — | Invention Alloys |
| V6051 | | 6.0 | — | — | 2.0 | .24 | .15 | .11 | — | Invention Alloys |
| V6053 | | 6.1 | — | — | 2.0 | .76 | .11 | .11 | — | Invention Alloys |
| V6054 | | 6.0 | — | — | 1.1 | .98 | .51 | .10 | — | Invention Alloys |
| V6066 | | 6.2 | — | .57 | 4.1 | — | .07 | .085 | — | Invention Alloys |
| V6067 | | 5.7 | — | 3.2 | 3.1 | — | .06 | .092 | — | Invention Alloys |
| V6069 | | 5.7 | — | 4.2 | — | .98 | .05 | .062 | — | Invention Alloys |
| V6073 | 50 | 5.2 | — | 2.2 | 2.4 | .50 | .06 | .07 | — | Invention Alloys |
| V6074 | 50 | 5.0 | — | 1.9 | 1.2 | .48 | .06 | .08 | — | Invention Alloys |
| V6106 | 50 | 5.2 | — | 2.6 | 2.1 | .50 | .08 | .13 | — | Invention Alloys |
| V6107 | 50 | 5.2 | — | 2.6 | 2.0 | .49 | .06 | .12 | — | Invention Alloys |
| V6108 | 50 | 5.1 | — | 2.6 | 2.0 | .47 | .05 | .14 | — | Invention Alloys |
| V6109 | 50 | 5.2 | — | 2.6 | 2.0 | .51 | .10 | .11 | — | Invention Alloys |
| V6133 | 100 | 5.0 | 1.0 | 0.9 | 1.0 | .82 | .07 | .08 | — | Invention Alloys |
| V6134 | 100 | 5.1 | 2.0 | — | 1.0 | .80 | .07 | .07 | — | Invention Alloys |
| V6135 | 100 | 5.2 | 1.1 | — | 1.0 | .84 | .07 | .07 | — | Invention Alloys |
| V6136 | 100 | 4.7 | 2.0 | 1.9 | 1.1 | .87 | .07 | .07 | — | Invention Alloys |
| V6137 | 100 | 5.2 | .55 | 1.8 | 2.0 | .55 | .08 | .07 | .1Si | Invention Alloys |
| V6138 | 100 | 5.0 | — | 1.9 | 2.0 | .56 | .08 | .07 | .0013Y | Invention Alloys |
| V6256 | 350 | 5.2 | 1.1 | 0.9 | 1.0 | .78 | .04 | .07 | .095Si | Invention Alloys |
| V6257 | 350 | 5.1 | 2.0 | 1.9 | 1.0 | .77 | .04 | .12 | .097Si | Invention Alloys |

$a^{03}$=Measured precrack length (average of lengths at two quarter-thickness points and mid-thickness point)-cm(in)

$f(a^{03}/W)$=Crack length function (equation given in ASTM E399-78)-dimensionless $A_L$=Total area within loading-unloading loop of load-deflection record-cm$^2$ (in$^2$)

$C_1$=Load scale factor on x-y recorder-kN/m(lb/in)

$C_2$ =Deflection scale factor on x-y recorder-cm/cm(in/in)

$a^{05}$=Measured precrack length (average of lengths at all five measurement points)-cm(in)

$a_>^5$=Measured total crack length corresponding to unloading point (average of lengths at all five measurement points)-cm(in)

$A_m$=Area under loading curve at maximum load-cm$^2$ (in$^2$)

Table II presents data with respect to the mechanical properties of the heats reported in Table I.

TABLE II

| Heat | Base Metal Properties YS | UTS | W/A | KQ | Weld W/A | KQ | Comments |
|---|---|---|---|---|---|---|---|
| V5954 | — | — | 3415 | 63 | 1519 | 59 | Baseline Alloys |
| V6026 | 100 | 116 | 3686 | 62 | 1246 | 82 | Baseline Alloys |
| V6055 | 97 | 107 | 4415 | 57 | 2554 | 63 | Baseline Alloys |
| V6027 | 104 | 119 | 2861 | 62 | 1235 | 80 | Conventional Alloys |
| V6065 | 99 | 117 | 1880 | 58 | 2549 | 62 | Conventional Alloys |
| V6049 | 105 | 118 | 2056 | 60 | 1463 | 64 | Inventional Alloys |
| V6050 | 107 | 120 | 2476 | 64 | 1067 | 64 | Inventional Alloys |
| V6051 | 105 | 119 | 2746 | 61 | 1441 | 62 | Inventional Alloys |

TABLE II-continued

| Heat | Base Metal Properties YS | UTS | W/A | KQ | Weld W/A | KQ | Comments |
|---|---|---|---|---|---|---|---|
| V6053 | 106 | 119 | 2648 | 61 | 1626 | 61 | Inventional Alloys |
| V6054 | 109 | 121 | 2336 | 63 | 940 | 61 | Inventional Alloys |
| V6066 | 103 | 116 | 2320 | 62 | 949 | 59 | Inventional Alloys |
| V6067 | 104 | 117 | 2268 | 61 | 2685 | 62 | Inventional Alloys |
| V6069 | 103 | 115 | 3068 | 58 | 3233 | 62 | Inventional Alloys |
| V6073 | 95 | 111 | 3397 | 57 | 2751 | 60 | Inventional Alloys |
| V6074 | 94 | 109 | 3259 | 54 | 3916 | 59 | Inventional Alloys |
| V6106 | 104 | 118 | 2380 | 58 | 2428 | 60 | Inventional Alloys |
| V6107 | 101 | 117 | 3114 | 57 | 2494 | 53 | Inventional Alloys |
| V6108 | 103 | 118 | 2637 | 52 | 2578 | 60 | Inventional Alloys |
| V6109 | 100 | 114 | 3336 | 56 | 3311 | 59 | Inventional Alloys |
| V6133 | 93 | 109 | 4171 | 57 | 4158 | 62 | Inventional Alloys |
| V6134 | 95 | 108 | 3699 | 58 | 2723 | 64 | Inventional Alloys |
| V6135 | 92 | 105 | 3995 | 57 | 3039 | 62 | Inventional Alloys |
| V6136 | 95 | 110 | 3789 | 56 | 3251 | 61 | Inventional Alloys |
| V6137 | 99 | 116 | 3506 | 61 | 3497 | 67 | Inventional Alloys |
| V6138 | 94 | 109 | 3483 | 57 | 2927 | 58 | Inventional Alloys |
| V6256 | 98 | 113 | 4627 | 56 | 2532 | 61 | Inventional Alloys |
| V6257 | 107 | 118 | 4023 | 61 | 1218 | 60 | Inventional Alloys |

YS = Yield Strength, ksi
TS = Tensile Strength, ksi
W/A = Energy Toughness, in · lbs./in$^2$
KQ = Linear Elastic Fracture Toughness, ksi-in.$^{\frac{1}{2}}$ The results reported in Table II, demonstrate that with the alloys in accordance with the invention, as compared to the baseline or conventional alloys, an improvement in weld energy toughness resulted with the alloys of the invention absent a corresponding improvement with regard to linear elastic fracture toughness. Therefore, the alloys of the invention exhibited resistance to rapid crack propagation once a crack started to propagate. As earlier discussed, this is an important, desired property in the alloys in accordance with the invention.

A method of illustrating the effects of the various alloying elements on the mechanical properties shown in Tables I and II is to subject the data of Tables I and II to multiple linear regression analyses. This is a mathematical procedure which yields an equation whereby the approximate value of a significant property may be calculated from the chemical composition of the alloy. The method assumes that the effect of an element is linear, that is, equal increments of the element will produce equal changes in the value of the property in question. This is not always the case as will be shown later for oxygen but the procedure provides a convenient method for separating and quantifying to some degree the effects of the various elements in a series of complex alloys.

Table III gives the results of multiple linear regression analyses of the data in Tables I and II. Only the alloys classed as invention alloys were used in these calculations. As an example of the use of Table III the equation for the base yield strength (YS) of an alloy would be:

$$\text{Base } YS\ (\text{ksi}) = 34.8 + 8.9(\%\ \text{Al}) + 3.04(\%\ \text{Sn}) + 2.02(\%\ \text{Zr}) + 0.2(\%\ \text{V}) + 13.6(\%\ \text{Fe}) + 106.7(\%\ \text{O}_2) + 67(\%\ \text{Si})$$

This confirms the aforementioned strengthening effects of aluminum, tin, zirconium, iron, oxygen, and silicon. In terms of energy toughness of the base material aluminum, tin, zirconium, iron and oxygen all have deleterious effects, particularly the latter two. Vanadium, molybdenum and silicon are all beneficial to this property. Energy toughness of the welds are adversely affected by aluminum, iron and oxygen to a much greater degree than that of the base metal. None of the other elements were indicated to have any significant effects, good or bad, on weld energy toughness.

TABLE III

RESULTS OF MULTIPLE LINEAR REGRESSION ANALYSES OF DATA IN TABLES I & II

| Property | Constant | Regression Coefficients Al | Sn | Zr | V | Mo | Fe | O$^2$ | Si |
|---|---|---|---|---|---|---|---|---|---|
| Base YS | 34.8 | 8.9 | 3.04 | 2.02 | 0.2 | — | 13.6 | 106.7 | 67.0 |
| Base $K_Q$ | 29.5 | 4.5 | 1.9 | 0.9 | NS | NS | 13.5 | NS | 32.5 |
| Base W/A | 5156 | −354 | −29 | −116 | 61 | 981 | −968 | −8127 | 6546 |
| Weld $K_Q$ | 50 | 2.3 | 1.8 | NS | NS | NS | NS | NS | NS |
| Weld W/A | 10163 | −1053 | NS | NS | NS | NS | −2844 | −14983 | NS |

Example of use:
Base YS (in ksi) = 34.8 +8.9 (% Al) + 3.04 (% Sn) + 2.02 (% Zr) + 0.2 (% V) + 13.6 (% Fe) + 106.7 (% $O_2$ + 67 (% Si)

Figure 2:
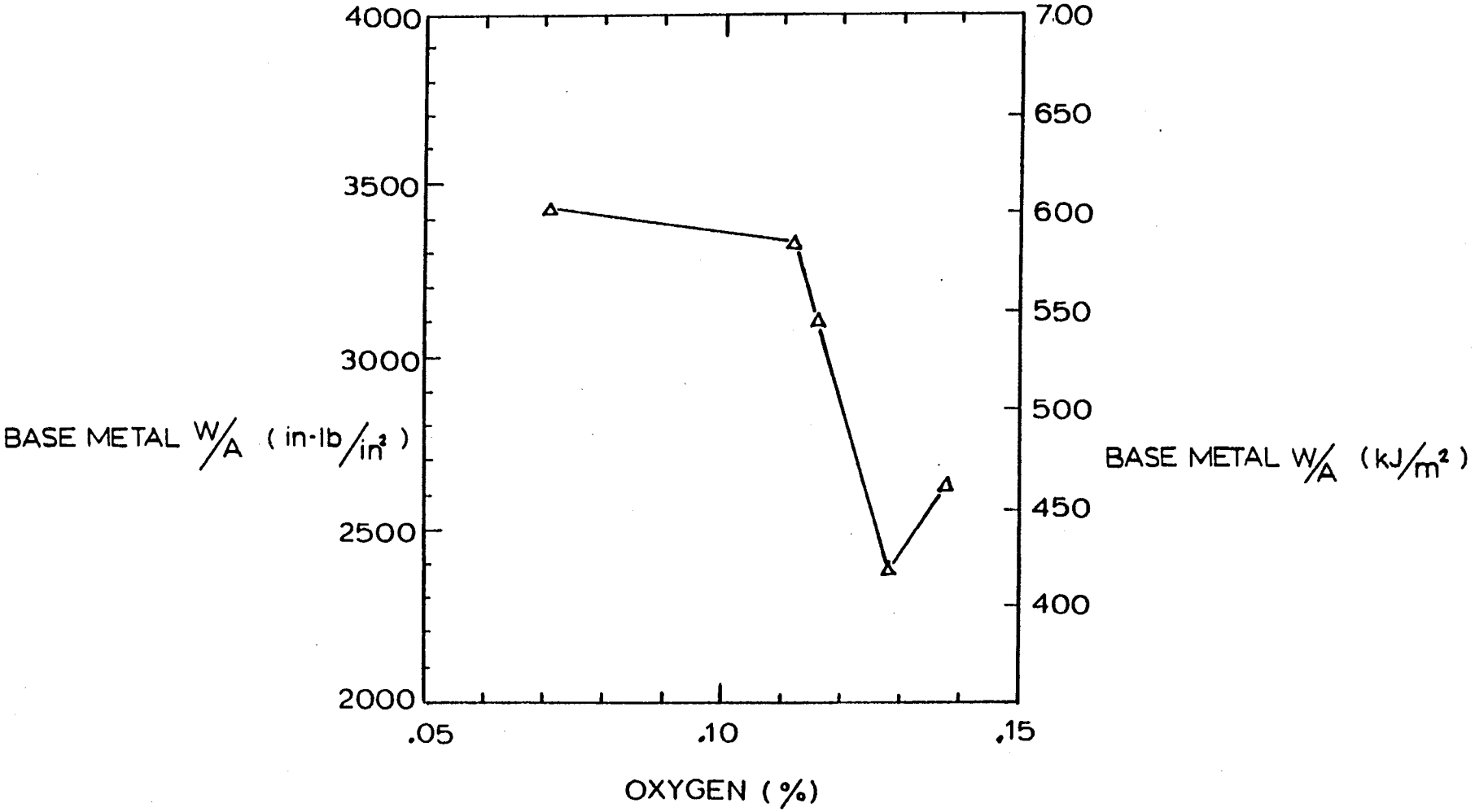
FIG. 2 is a graph showing the effect of oxygen content on energy toughness (W/A) for the alloy Ti-5Al-2Zr-2V-0.5Mo.
Figure 3:
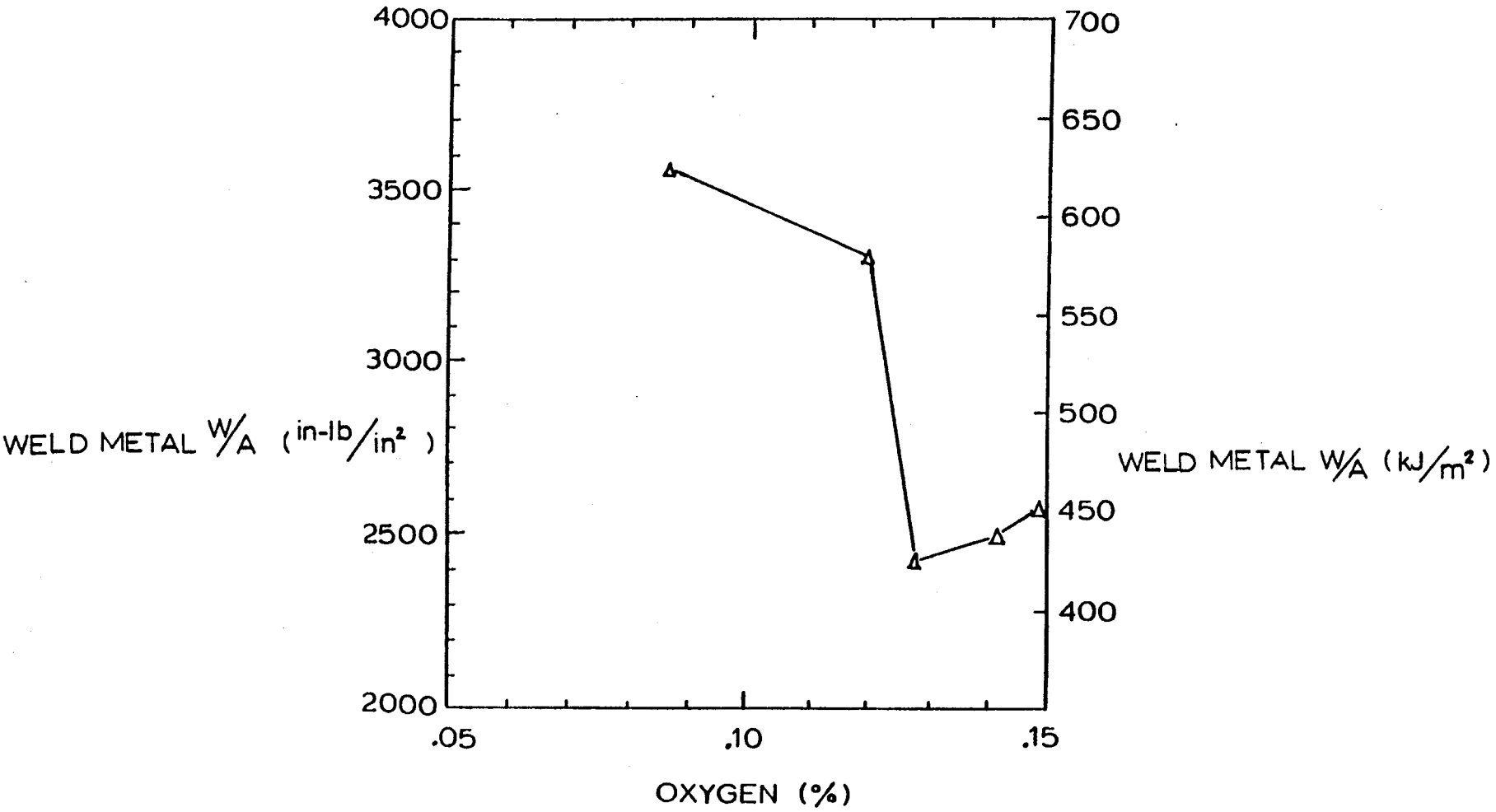
FIG. 3 is a graph showing the effect of oxygen content on the energy toughness (W/A) of the weld of the alloy Ti-5Al2Zr-2V-0.5Mo.

As may be seen from Table III and FIGS. 1, 2 and 3, oxygen within the limits of the invention contributes significantly to strengthening but above the limit of the invention oxygen degrades the toughness of the alloy. As shown in FIG. 1, the effect of oxygen on yield strength is linear and increased oxygen results in a corresponding increase in yield strength. In contrast, as shown in FIGS. 2 and 3, the effect of oxygen on toughness is non-linear. Specifically, when oxygen is increased above the limits of the invention, a drastic degradation in toughness results. Consequently, although oxygen is beneficial from the standpoint of achieving the required strength it must not exceed the upper limits of the invention if toughness is to be retained to achieve the desired combination of high strength and toughness.

With respect to the effect of iron, reference should be made to Table III. The data show that an increase in iron to levels exceeding the limits of the invention would increase strength but seriously degrade toughness, particularly in the weld.

Molybdenum additions exceeding 1%, especially in combination with vanadium additions of over 1%, generally appear to result in excessive hardening in weld heat-affected zones (HAZ). This is demonstrated by heats B5371, B5374 through B5377, B5088 and B5093, B5170 and B5126, and finally B5278 and B5121 of Table IV. This table summarizes the results of a 250 gm button heat study designed to assess chemistry effects in weldments. In this study, autogenous welds were made in 0.1' thick sheets rolled from the 250 gm button heats. Hardness measurements were then taken from the fusion zone across the HAZ (heat affected zone) and into the base metal. Since it was desired to minimize strength differences between the HAZ and base metal, a low hardness differential was desired between the HAZ and base metal. While earlier data showed that molybdenum is a desirable addition for improving base metal toughness, the Table IV data suggest that molybdenum should not exceed 1%. Heats B5374 through B5378 show that molybdenum can be safely added at the 0.5% level, even in the presence of 3% vanadium.

Heats B5250 through B5255 and B5170, B5179, and B5180 were designed to evaluate the effects of iron additions up to 0.5% and to compare these effects with a 0.5% molybdenum or a 1% vanadium addition. The results indicated that iron is a more effective strengthener than the other additions.

TABLE IV

PROPERTIES OF SHEET MADE FROM ½-LB. MELTS

| Heat No. | Nominal Composition, Wt. % Al | Sn | Zr | V | Mo | Fe | Other | UTS ksi | YS ksi | % Elong | Max. Δ KHN[1] in HAZ |
|---|---|---|---|---|---|---|---|---|---|---|---|
| B-5371 | 6 | — | — | — | 1 | 0.95 | — | 126 | 119 | 14 | 60 |
| B-5179 | 6 | — | — | 2 | 0.5 | 0.1 | — | 125 | 114 | 11 | 72 |
| B-5373 | 6 | — | — | 3 | 0.1 | 0.1 | — | 122 | 114 | 10 | 49 |
| B-5374 | 6 | — | — | 3 | 0.25 | 0.1 | — | 125 | 117 | 12 | 54 |
| B-7375 | 6 | — | — | 3 | 0.5 | 0.1 | — | 125 | 117 | 11 | 48 |
| B-5376 | 6 | — | — | 3 | 0.75 | 0.1 | — | 126 | 117 | 8 | 68 |
| B-5377 | 6 | — | — | 3 | 1.0 | 0.1 | — | 127 | 118 | 11 | 82 |
| B-5378 | 6 | — | — | 3 | 0.25 | 0.5 | — | 127 | 119 | 9 | 54 |
| B-5088 | 6 | — | — | 4 | — | 0.05 | $0.07O_2$ | 127 | 114 | 13 | 60 |
| B-5089 | 6 | — | — | 4 | — | 0.05 | 0.05Si, $0.07O_2$ | 125 | 116 | 12 | 52 |
| B-5090 | 6 | — | — | 4 | — | 0.05 | 0.10Si, 0.07O2 | 125 | 115 | 9 | 67 |
| B-5091 | 6 | — | — | 4 | — | 0.5 | 0.15Si, $0.07O_2$ | 128 | 117 | 10 | 43 |
| B-5093 | 6 | — | — | 4 | 0.8 | 0.05 | $0.07O_2$ | 132 | 120 | 11 | 112 |
| B-5087 | 6 | — | 2 | 3 | 0.8 | 0.05 | $0.07O_2$ | 131 | 121 | 12 | 71 |
| B-5121 | 6 | 2 | — | 1 | 1 | 0.1 | — | 134 | 121 | 13 | 27 |
| B-5278 | 6 | 2 | — | 2 | 1 | 0.1 | — | 135 | 121 | 13 | 56 |
| B-5382 | 5.5 | 1 | 2 | 2 | 0.8 | 0.15 | 1Nb | 125 | 115 | 10 | 61 |
| B-5383 | 5.5 | 1 | 2 | 2 | 0.8 | 0.15 | 1Nb, 0.09Si | 129 | 119 | 12 | 63 |
| B-5096 | 5.5 | 1 | 2 | 2 | 0.8 | 0.15 | 1Nb, 0.1Cu, 0.09Si | 138 | 130 | 12 | 78 |
| B-5097 | 5.5 | 1 | 2 | 2 | 0.8 | 0.15 | 1Nb, 0.1Cr, 0.09Si | 139 | 128 | 9 | 72 |
| B-5098 | 5.5 | 1 | 3 | 2 | 0.8 | 0.15 | 1Nb, 0.1Cu, 0.09Si | 141 | 132 | 10 | 70 |
| B-5086 | 5 | — | 1 | 3 | — | 0.2 | 1Nb, 0.09Si, $0.1O_2$ | 123 | 111 | 12 | 77 |
| B-5126 | 5 | — | 4 | 2 | 1 | 0.1 | — | 124 | 115 | 9 | 71 |
| B-5277 | 5 | 1 | 2 | 1 | 1 | 0.3 | — | 128 | 117 | 13 | 20 |
| B-5255 | 5 | 1 | 3 | 1 | 0.5 | 0.2 | — | 126 | 116 | 13 | 50 |
| B-5169 | 5 | 2 | 4 | 2 | 0.5 | 0.1 | — | 130 | 119 | 12 | 68 |
| B-5176 | 5 | 4 | — | 2 | — | 0.1 | — | 129 | 118 | 13 | 24 |
| B-5170 | 5 | — | 4 | 2 | — | 0.1 | — | 123 | 114 | 12 | 44 |

[1]Hardness difference between heat affected zone of weld and base metal hardness.

However, as shown earlier, iron also has a pronounced deleterious effect on weld toughness. Silicon additions at or below 0.15% did not appear to adversely affect weld stability. Comparing Heats B5088 through B5091 and B5382 and B5383 of Table IV, it can be seen that silicon has a moderate strengthening effect without any apparent weld stability effects.

As noted earlier, an important desired property of the invention alloy is a high degree of immunity to stress corrosion cracking (SCC). In order to demonstrate the invention alloy's superior SCC resistance, 1-in. plate from an 1800-lb. heat was tested as follows:

(a) Standard ASTM WOL type specimens were precracked in air using a maximum stress intensity (K) value half that to be used for the succeeding test.

(b) Following precracking, specimens were loaded in a static frame to the desired K level. The environment was 3.5% NaCl in distilled water. Specimen load and crack mouth opening were monitored.

(c) If no crack growth was observed in a test period of 150 hours minimum, the specimen was removed, the crack was extended by fatigue cracking and the specimen was returned to the test at a higher applied K. This procedure was repeated until either the crack grew because of SCC or mechanical failure, or the results become inappropriate for analysis by fracture mechanics methods.

(d) At the end of the test, the specimens were broken open and final measurements were made of crack lengths and other dimensions; the calculations were made on the basis of these measurements. The results of these tests are given in Table V.

The results in Table V clearly show that the invention alloy is immune to stress corrosion cracking—i.e., no crack extension occurred even though material was loaded to greater than 100% of the linear elastic fracture toughness value ($K_Q$). Significantly, the alloy showed resistance to SCC even after a vacuum creep flatten operation (slow cool from 1450° F.), said operation being known to render other conventional alloys such as Ti-6Al -4V susceptible to SCC.

TABLE V

SCC TEST RESULTS FOR 25 mm (1-IN) PLATE ROLLED FROM HEAT V-6447[1]

| Plate No. | Original Condition | Heat Treat | Avg $K_Q$ ksi-in$^{\frac{1}{2}}$ | SCC Test Results[7] Crack[6] Length, In | K ksi-in$^{\frac{1}{2}}$ | Time Hrs. | Crack Extension |
|---|---|---|---|---|---|---|---|
| 2 | Mill Annealed[2] | None | 84.4 | 0.799 | 51.8 | 240 | None |
| | | | | 1.142 | 66.9 | 168 | None |
| | | | | 1.227 | 63.5 | 165 | None |
| | | | | 1.417 | 70.2 | 167 | None |
| | | | | 1.683 | 88.7 | 624 | None |
| 1 | VCF[3] | A[4] | 83.8 | 0.686 | 45.9 | 240 | None |
| | | | | 1.057 | 59.4 | 163 | None |
| | | | | 1.236 | 70.2 | 166 | None |
| | | | | 1.490 | 78.8 | 167 | None |
| | | | | 1.620 | 86.0 | 624 | None |
| 1 | VCF[3] | B[5] | 80.3 | 0.665 | 42.9 | 240 | None |
| | | | | 1.080 | 60.0 | 164 | None |
| | | | | 1.278 | 68.7 | 166 | None |
| | | | | 1.520 | 77.8 | 167 | None |
| | | | | 1.738 | 87.6 | 624 | None |

[1]Heat chemistry = Ti—5.2Al—1.0Sn—1.2Zr—1.0V—0.8Mo—.05Fe—.09Si—.08$O_2$
Avg YS = 101 ksi, Avg UTS = 118 ksi
[2]949 C. (1740 F.) (1 hr) AC.
[3]Vacuum creep flattened 788 C. (1450 F.), slow cooled.
[4]949 C. (1740 F.) (1 hr) AC.
[5]933 C. (1820 F.) (1 hr) AC + 949 C. (1740 F.) (1 hr) AC.
[6]Crack was extended by fatigue between each exposure
[7]Tested in aqueous 3.5NaCl solution

What is claimed is:

1. A titanium base alloy having a combination of high strength and toughness in both the welded and unwelded condition, and immunity from stress corrosion cracking in an aqueous 3.5% NaCl solution, said alloy consisting essentially of, in weight percent, aluminum 4 to 5.5, tin up to 2.5, zirconium up to 2.5, vanadium 0.5 to 2.5, molybdenum 0.3 to 1, silicon up to 0.15, oxygen 0.04 to 0.12, iron 0.01 to 0.12 and balance titanium and incidental impurities.

2. A titanium base alloy having a combination of high strength and toughness in both the welded and unwelded condition, and immunity from stress corrosion cracking in an aqueous 3.5% NaCl solution, said alloy consisting essentially of, in weight percent, aluminum 4.5 to 5.5, tin 0.5 to 1.5, zirconium 0.5 to 1.5, vanadium 0.5 to 1.5, molybdenum 0.6 to 1, silicon 0.07 to 0.13, oxygen 0.07 to 0.11, iron 0.01 to 0.09 and balance iron and incidental impurities.

3. A titanium base alloy having a combination of high strength and toughness in both the welded and unwelded condition, and immunity from stress corrosion cracking in an aqueous 3.5% NaCl solution, said alloy consisting essentially of, in weight percent, aluminum about 5, tin about 1, zirconium about 1, vanadium about 1, molybdenum about 0.8, silicon about 0.1, oxygen about 0.09, iron about 0.07 and balance titanium and incidental impurities.

4. The alloy of claim 1 or claim 2 or claim 3 in the form of a weldment.

* * * * *